US009844735B2

(12) United States Patent
Tao et al.

(10) Patent No.: US 9,844,735 B2
(45) Date of Patent: Dec. 19, 2017

(54) SINGLE PULL TOY VEHICLE LOADER AND LAUNCHER

(71) Applicant: Mattel, Inc., El Segundo, CA (US)

(72) Inventors: Ken Tao, Hong Kong (CN); Gerry Cody, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/159,658

(22) Filed: May 19, 2016

(65) Prior Publication Data

US 2016/0263487 A1 Sep. 15, 2016

Related U.S. Application Data

(63) Continuation of application No. 14/576,328, filed on Dec. 19, 2014, now Pat. No. 9,387,410.

(51) Int. Cl.

| | |
|---|---|
| ***A63H 18/00*** | (2006.01) |
| ***A63H 17/00*** | (2006.01) |
| ***A63H 18/02*** | (2006.01) |

(52) U.S. Cl.

CPC ..... *A63H 17/008* (2013.01); *A63H 18/00* (2013.01); *A63H 18/02* (2013.01)

(58) Field of Classification Search

USPC ..... 446/14, 73, 74, 89, 217, 424, 425, 426, 446/429, 444

See application file for complete search history.

(56) References Cited

U.S. PATENT DOCUMENTS

| | | | | |
|---|---|---|---|---|
| 1,318,708 | A | 10/1919 | Turner | |
| 1,356,324 | A | 10/1920 | Turner | |
| 1,382,812 | A | 6/1921 | Turner | |
| 2,017,778 | A | 10/1935 | Vido | |
| 2,517,084 | A | 8/1950 | Carver | |
| 2,563,969 | A | 8/1951 | Skinner | |
| 2,803,922 | A | 8/1957 | Holt | |
| 3,693,282 | A | 9/1972 | Adicks | |
| 4,108,437 | A | 8/1978 | Deanda et al. | |
| 4,146,991 | A * | 4/1979 | Sano | A63H 18/028 446/430 |
| 4,267,661 | A | 5/1981 | Hanson | |
| 4,345,402 | A | 8/1982 | Hanson et al. | |
| 4,403,440 | A | 9/1983 | Wulff | |
| 4,418,495 | A | 12/1983 | Kennedy et al. | |
| 4,423,871 | A * | 1/1984 | Mucaro | A63H 18/026 446/429 |
| 4,475,303 | A | 10/1984 | Ribas et al. | |
| 4,479,326 | A | 10/1984 | Kennedy et al. | |
| 4,504,242 | A | 3/1985 | Crain et al. | |

(Continued)

*Primary Examiner* — Nini Legesse

(74) *Attorney, Agent, or Firm* — Sheppard, Mullin, Richter & Hampton LLP

(57) ABSTRACT

A loading and launching device for toy vehicles is disclosed that is actuated with a single pull of an actuator to both load and launch a toy vehicle, such as onto a toy vehicle track set. The device includes a horizontal toy vehicle loader and a toy vehicle launcher that are coupled to one another, such that as the launcher moves rearward, the loader moves from a vehicle receiving and loading position (in which the loading and launching device may receive a toy vehicle returning from the toy track set) to a launch position that pushes a toy vehicle into position directly in front of the launcher. When the launcher is released, it contacts and launches the toy vehicle.

20 Claims, 9 Drawing Sheets

(56) References Cited

U.S. PATENT DOCUMENTS

| | | | | | |
|---|---|---|---|---|---|
| 4,526,554 | A | | 7/1985 | Goldfarb et al. | |
| 4,605,230 | A | * | 8/1986 | Halford | A63F 7/2409 124/61 |
| 4,642,066 | A | | 2/1987 | Kennedy et al. | |
| 4,690,658 | A | | 9/1987 | Crosson et al. | |
| 4,732,569 | A | * | 3/1988 | Hippely | A63H 17/008 446/430 |
| 4,737,135 | A | | 4/1988 | Johnson et al. | |
| 5,234,216 | A | | 8/1993 | Ostendorff | |
| 5,254,030 | A | * | 10/1993 | Ostendorff | A63H 18/026 124/26 |
| 5,316,514 | A | | 5/1994 | Ellman et al. | |
| 5,460,560 | A | | 10/1995 | Liu | |
| 5,522,752 | A | | 6/1996 | Liu | |
| 5,525,085 | A | | 6/1996 | Liu | |
| 5,586,923 | A | * | 12/1996 | Hippely | A63H 17/008 446/14 |
| 5,674,105 | A | | 10/1997 | Hamlin | |
| 5,711,285 | A | | 1/1998 | Stewart et al. | |
| 5,871,385 | A | * | 2/1999 | Hippely | A63H 18/028 446/424 |
| 6,000,992 | A | * | 12/1999 | Lambert | A63H 18/026 446/430 |
| 6,106,356 | A | | 8/2000 | Trageser | |
| 6,676,480 | B2 | | 1/2004 | Sheltman | |
| 7,934,970 | B2 | | 5/2011 | O'Connor | |
| 8,388,405 | B2 | | 3/2013 | Desent et al. | |
| 8,628,373 | B2 | | 1/2014 | Payne | |
| 9,387,410 | B1 | * | 7/2016 | Tao | A63H 17/008 |
| 2011/0294395 | A1 | * | 12/2011 | O'Connor | A63H 18/023 446/429 |
| 2013/0309937 | A1 | | 11/2013 | Ostendorff | |
| 2014/0051326 | A1 | | 2/2014 | Nuttall et al. | |

* cited by examiner

SINGLE PULL TOY VEHICLE LOADER AND LAUNCHER

CROSS REFERENCE TO RELATED APPLICATION

This application is a continuation application and claims the benefit, under 35 U.S.C. §120, of U.S. patent application Ser. No. 14/576,328, filed Dec. 19, 2014, the disclosure of which is herein incorporated by reference in its entirety.

FIELD OF THE INVENTION

The present invention relates to launching of toy vehicles, and more particularly to a toy vehicle loader and launcher that both loads and launches a toy vehicle with a single pull of an actuator.

BACKGROUND

Toy vehicle playsets and track sets are popular among children of varied ages, and a variety of track configurations have previously been provided that include various features to add to the excitement a child experiences while playing with the toy. For instance, toy vehicle playsets and track sets have been provided having toy vehicle loading devices that sequentially load toy vehicles into a launch position, and others that include track portions that are moveable and that may change position with respect to other portions of the track during play, and that may change the position of a toy vehicle at differing locations along the track.

While some prior art configurations provide such auto-loading features, they typically require that multiple toy vehicles be provided and be pre-positioned in some aligned, stacked, or other feeding configuration that will allow the inventory of toy vehicles to be sequentially moved into a launch position as each toy vehicle is launched. It would be advantageous to provide a track set configuration in which a toy vehicle completing travel through the track set ends up automatically in alignment with a loading device, ready to be directed to a launcher when the launcher is engaged to again launch a toy vehicle through the track set.

While some of the prior art references rely upon a gravity feed construction to sequentially feed toy vehicles into a launch position as another toy vehicle is launched, others have used moveable platforms to carry one toy vehicle at a time from its storage location to a launcher. For instance, U.S. Pat. No. 5,254,030 to Ostendorff et al. describes a rotatable turntable that moves first into alignment with a toy vehicle loader, receives a toy vehicle, and thereafter rotates into alignment with a launcher as a user manually controls a handle. The Ostendorff et al. mechanism again requires pre-loading multiple toy vehicles into the loader, and relies upon a rather complex turntable movement that must travel back and forth between multiple loaders to continuously load and launch toy vehicles. It would be advantageous to provide a track set in which a toy vehicle travelling through the set automatically returns to a loader, and that may be repeatedly returned to a launch position and automatically launched through a single, more simplistic and controlled operating movement than provided for in the prior art.

Thus, while certain prior configurations have provided changeable configurations of various toy vehicle track set elements during play, there remains an ongoing general need to provide toy vehicle track set features capable of maintaining the interest of a child and increasing the excitement and amusement they experience when playing with a toy vehicle track set. It would therefore be advantageous to provide a toy vehicle track set with unique toy vehicle paths and positioning mechanisms to further enhance the excitement and amusement offered to a child as they engage in such play.

SUMMARY OF THE INVENTION

Disclosed is a loading and launching device for toy vehicles that may be actuated with a single pull of an actuator to both load and launch a toy vehicle, such as onto a toy vehicle track set. In accordance with certain aspects of an embodiment of the invention, the loading and launching device receives a toy vehicle traveling through a track set, automatically aligns the toy vehicle with a loading mechanism, and through a single, repeatable, simplistic and controlled operating movement loads the toy vehicle into a launch position and launches the vehicle from that launch position.

In accordance with further aspects of an embodiment of the invention, the loading and launching device includes a horizontal toy vehicle loader and a toy vehicle launcher that are preferably coupled to one another, such as by way of a mechanical coupling. The launcher includes a handle and a launch rod, and is spring-biased on the underside of the launcher toward a forward end of the loading and launching device. Thus, as a child pulls the launcher rearward, potential energy is stored in a spring member below the launcher, and is converted to kinetic energy when the launcher is released so as to propel the launcher forward, and in turn propel a toy vehicle positioned in front of the launcher forward and preferably onto a toy track set.

The horizontal toy vehicle loader is positioned adjacent the launcher, and includes a pusher positioned for movement in a direction generally perpendicular to the direction of movement of the launcher. Because the loader and launcher are coupled to one another, as the launcher moves rearward, the loader moves from a vehicle receiving and loading position (in which the loading and launching device may receive a toy vehicle returning from the track set) to a launch position in which a toy vehicle is positioned directly in front of the launcher. When the launcher is released, it thus contacts and launches the toy vehicle. The loader may optionally be spring-biased to its toy vehicle receiving and loading position, or may alternatively be coupled to the launcher to return to such position as the launcher moves to its forward-most position.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
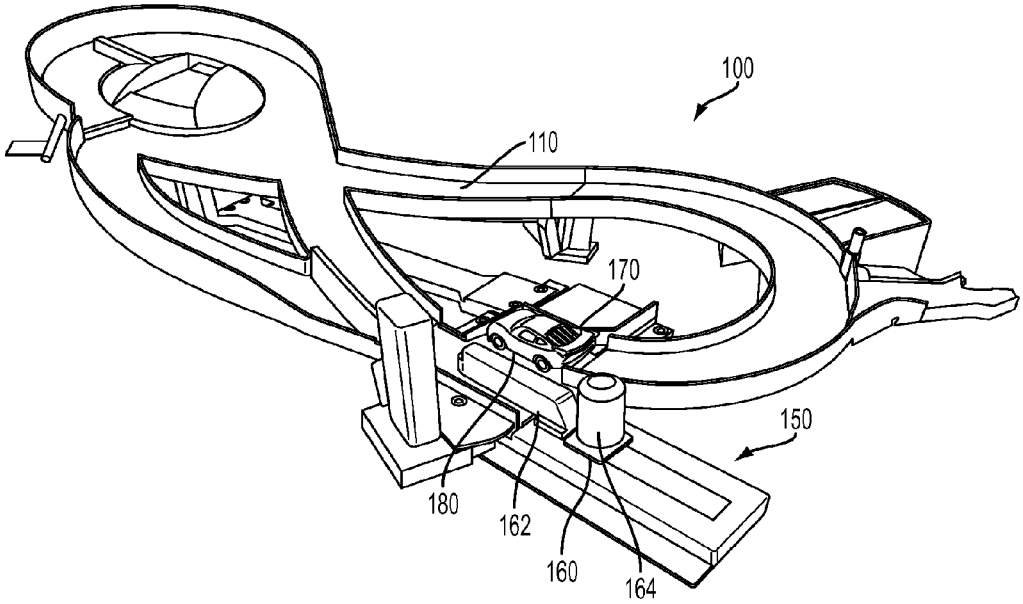
FIG. 1 is a perspective view of a toy vehicle track set including a toy vehicle loader and launcher in accordance with certain aspects of an embodiment of the invention.
Figure 2:
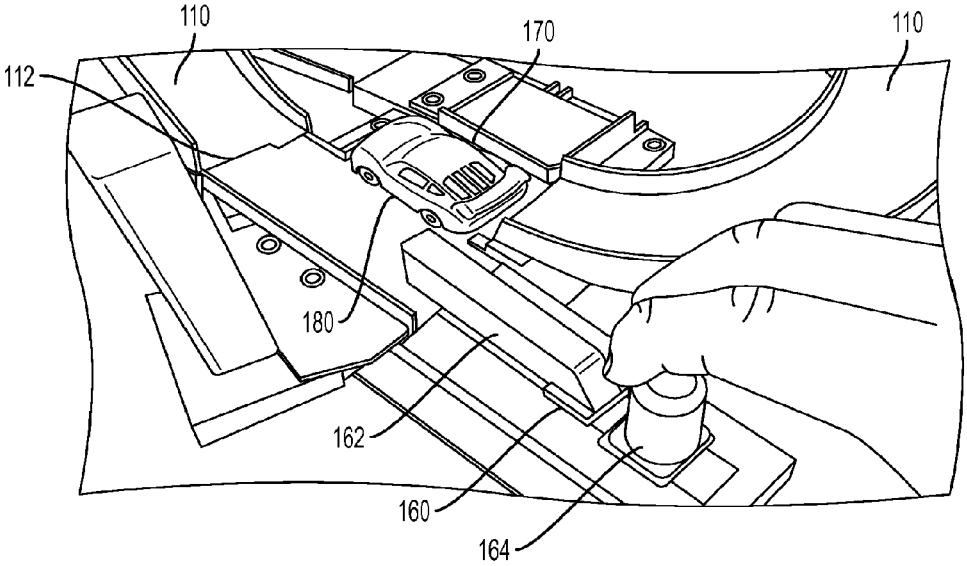
FIG. 2 is a close-up perspective view of the toy vehicle loader and launcher of FIG. 1 in a first configuration.
Figure 3:
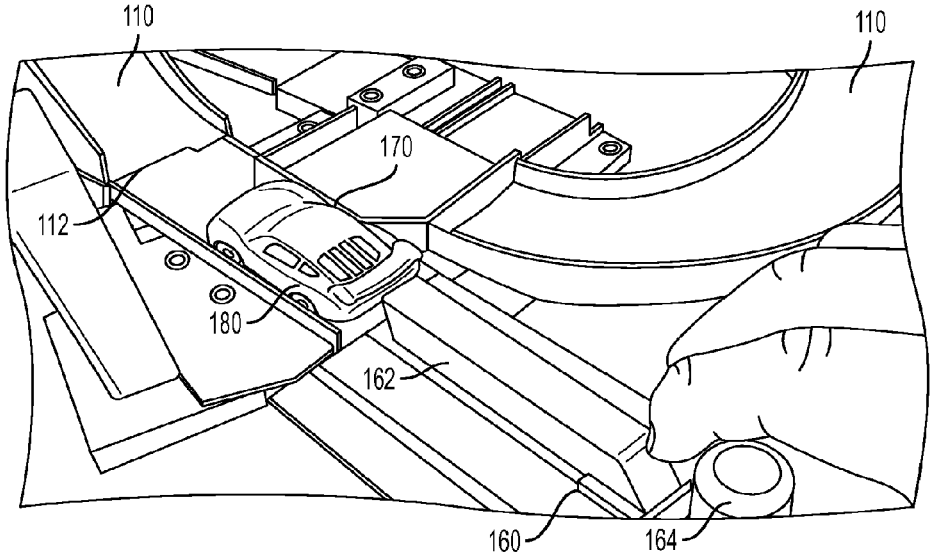
FIG. 3 is a close-up perspective view of the toy vehicle loader and launcher of FIG. 1 in a second configuration.

In accordance with an embodiment of the invention, a toy vehicle track set 100 including a toy vehicle loader and launcher 150 is shown in FIG. 1. Toy vehicle track set 100 also preferably includes a track loop portion 110 that attaches to toy vehicle loader and launcher 150, such that a toy vehicle launched from a launcher 160 of toy vehicle loader and launcher 150 travels into and around the loop portion 110, and returns from loop portion 110 to a toy vehicle loader 170 on toy vehicle loader and launcher 150. As discussed in greater detail below, toy launcher 160 is configured to be moved from a launch position (i.e., the position of the launcher immediately after it has launched a toy vehicle into track loop portion 110, as shown in FIG. 1) to a toy vehicle loading position, in which the toy vehicle is positioned in front of the launcher for subsequent launch into track loop portion 110 (as shown in FIG. 3). Likewise, toy vehicle loader 170 is configured to horizontally push a toy vehicle 180 that has traveled through track loop portion 110 and returned to toy vehicle loader 170 into a launch position in front of launcher 160. FIG. 2 shows toy vehicle 180 at an intermediate position as it is being pushed by vehicle loader 170 into alignment with launcher 160. Moreover, launcher 160 and loader 170 are coupled to one another, such as through a mechanical coupling, such that movement of the launcher 160 from the launch position to the load position moves the loader so as to push toy vehicle 180 from loader 170 to its launch position in front of launcher 160. Thereafter, the user may cause launcher 160 to launch toy vehicle 180 forward and again into track loop portion 110.

Figure 4:
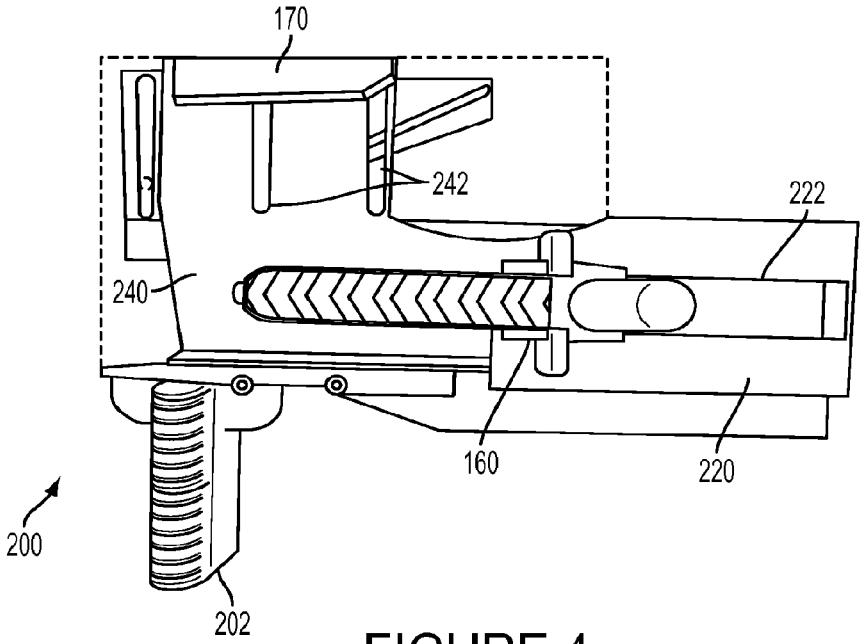
FIG. 4 is a top view of a toy vehicle loader and launcher in accordance with further aspects of an embodiment of the invention.
Figure 5:
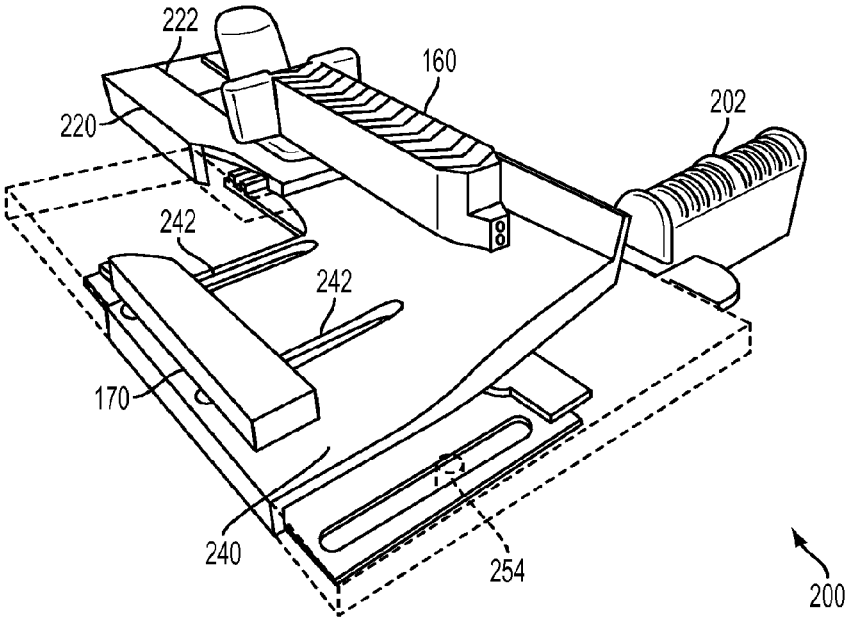
FIG. 5 is a front perspective view of the toy vehicle loader and launcher of FIG. 4.

Toy vehicle loader and launcher 150 includes a base 200 holding launcher 160 and loader 170. As shown in the partial sectional views of FIGS. 4 and 5, base 200 may include a handle 202 which may be gripped by a user when manipulating launcher 160, a launcher base section (shown generally at 220), and a loader base section (shown generally at 240) extending outward to a side of launcher base section 220. Launcher base section 220 has an elongate launcher slot 222 extending through base 200 and aligned with an entrance portion 112 (FIGS. 2 and 3) of track loop portion 110. Elongate launcher slot 222 is configured to receive launcher 160 as further detailed below, and extends rearward along launcher base section 220 a sufficient distance so as to allow rearward positioning of launcher 160 in a launch position and placement of a toy vehicle in its launch position in front of launcher 160. Likewise, loader base section 240 has one or more loader slots 242 extending through base 200 and aligned at an angle to launcher slot 222, and preferably at approximate 90 degrees to launcher slot 222.

A front edge of base 200 may have a front track connector configured to attach base 200 to entrance portion 112 of loop portion 110. Likewise, a back edge of loader base section 240 may have a rear track connector configured to attach base 200 to an exit portion 114 of loop portion 110. Each of the front track connector and the rear track connector may comprise, by way of non-limiting example, tabs configured for connection to slots on the underside of extruded plastic track sections of standard configuration known to those skilled in the art.

Figure 6:
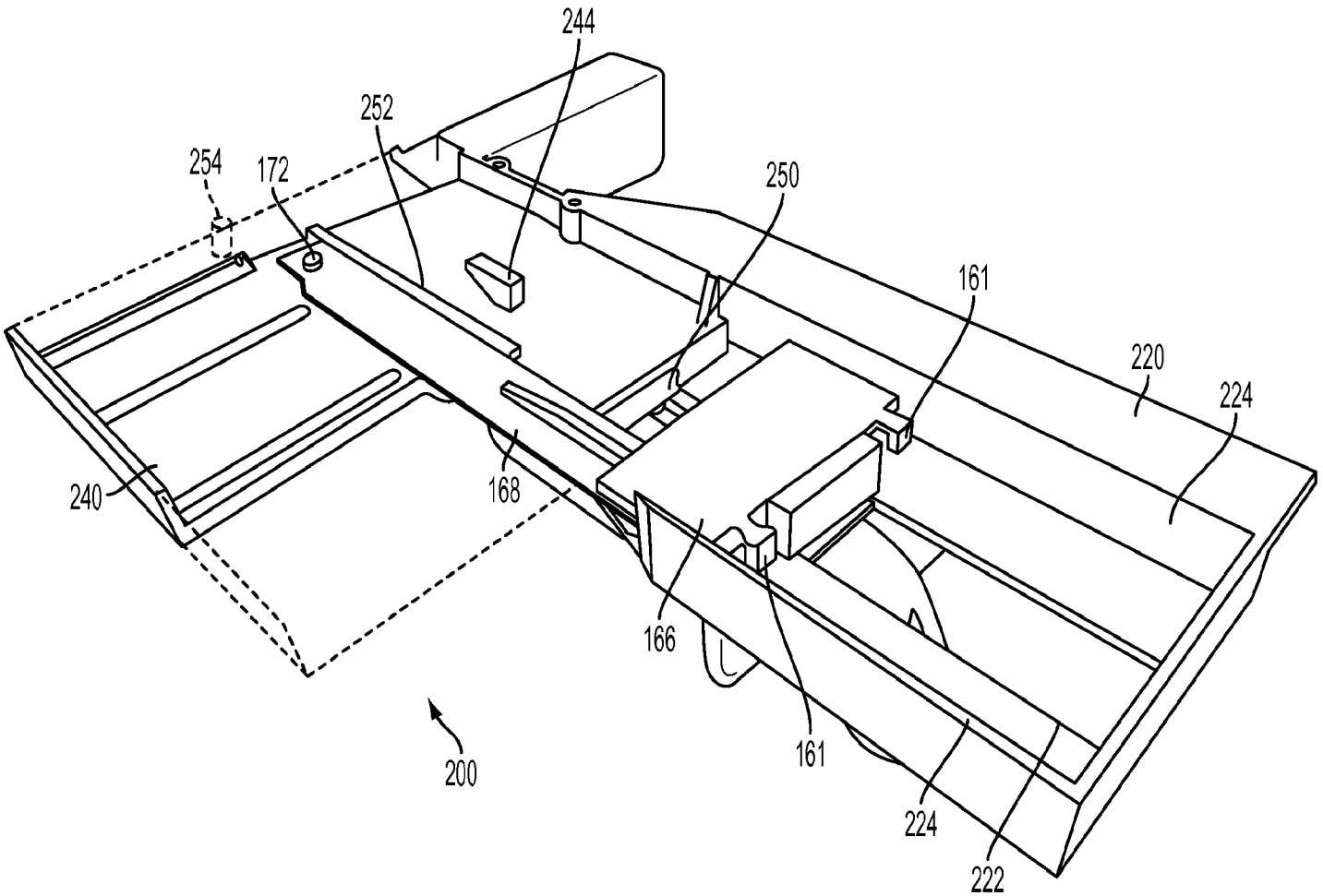
FIG. 6 is a bottom, rear perspective view of the toy vehicle loader and launcher of FIG. 4.

Referring to the bottom view of base 200 of FIG. 6 (with actuator plate 190 removed for clarity), launcher base section 220 of base 200 has side walls 224 extending parallel to launcher slot 222 and preferably extending along the full length of launcher slot 222. As will be discussed in greater detail below, a launcher bracket 166 is configured to ride in launcher slot 222 while carrying a launch rod 162 between the toy vehicle launch and load positions described above. Side walls 224 are spaced apart a sufficient distance so as to allow launcher bracket 166 to slide unimpaired through launcher slot 22 while helping to keep the outer edges of launcher bracket 166 aligned and within a gap defined between side walls 224. The front end of launcher slot 222 may optionally have a cushion member 250, such as a foam pad or a spring biased plate, mounted thereon that may protect the front edge of launcher slot 222 from damage from repeated impacts of launch rod 162 as it springs forward to launch a toy vehicle.

Figure 7:
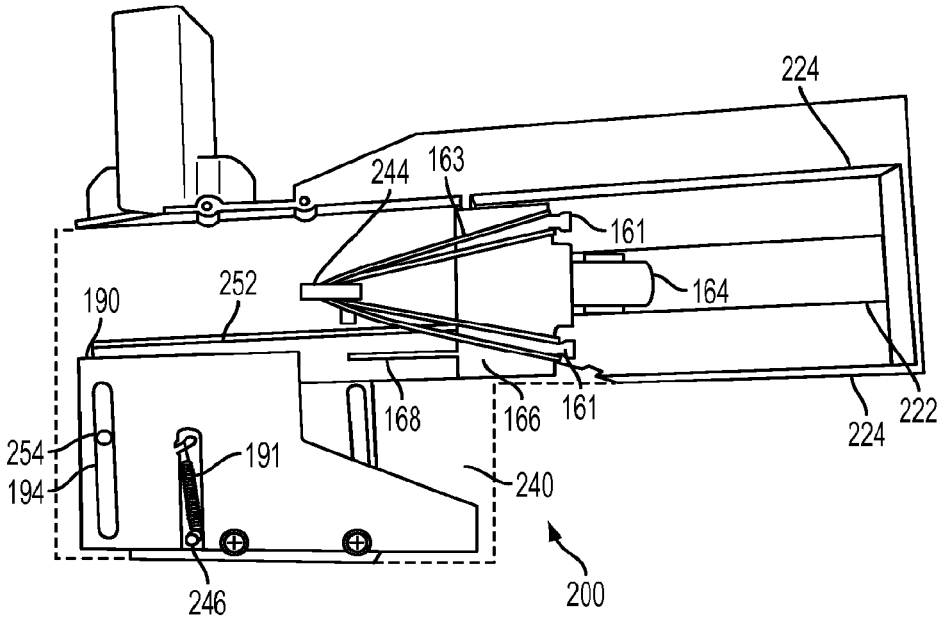
FIG. 7 is a bottom view of the toy vehicle loader and launcher of FIG. 4.

As shown in the bottom view of base 200 of FIG. 7, launcher base section 220 of base 200 also has a launcher spring anchor 244 extending downward from the bottom side of launcher base section 220 in front of launcher slot 222 and preferably centrally aligned with launcher slot 222. Launcher spring anchor 244 is configured to receive a first end of a launcher spring 163, here (by way of non-limiting example) a rubber band, that is used to propel launch rod 162.

Likewise, and with continued reference to FIGS. 6 and 7, loader base section 240 of base 20 has a loader spring anchor 246 extending downward from the bottom side of loader base section 240 adjacent an outer side edge of loader base section 240. Loader spring anchor 246 is configured to receive a first end of a loader spring 191 that is used to reset an actuator plate 190 of loader 170 to its vehicle receiving position (shown in FIG. 7). Loader base section 240 also has a downwardly extending extension rod guide 252 that extends parallel to launcher slot 222 and is generally aligned with an edge of launcher slot 222 that is closest to loader base section 240. Extension rod guide 252 provides a guide surface that helps to guide an extension rod 168 of launcher 160 as launcher 160 moves from the load position to the launch position.

Loader base section 240 also preferably includes a guide post 254 extending downward from the bottom of base 200. Guide post 254 is preferably positioned adjacent a front end of base 200, and is positioned to slide within a guide slot 194 on actuator plate 190 to assist in guiding actuator plate 190 as it moves from its vehicle receiving position to the vehicle loading position, advice versa.

Figure 8:
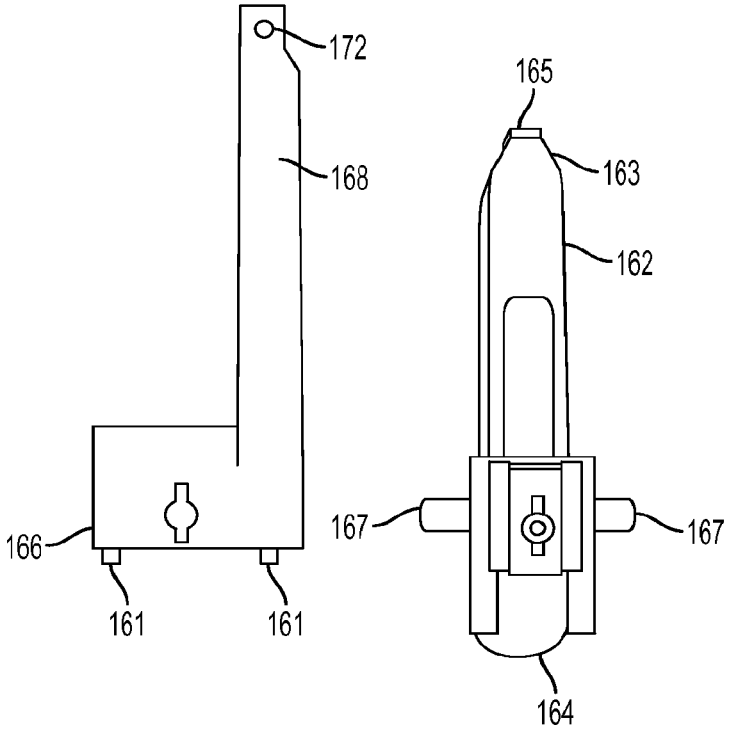
FIG. 8 is a bottom view of the toy vehicle launcher of FIG. 4.
Figure 9:
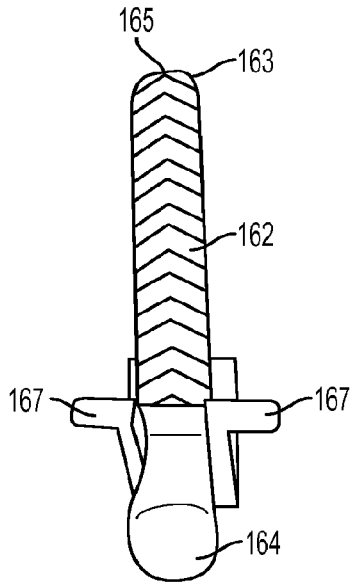
FIG. 9 is atop view of the toy vehicle launcher of FIG. 4.
Figure 10:
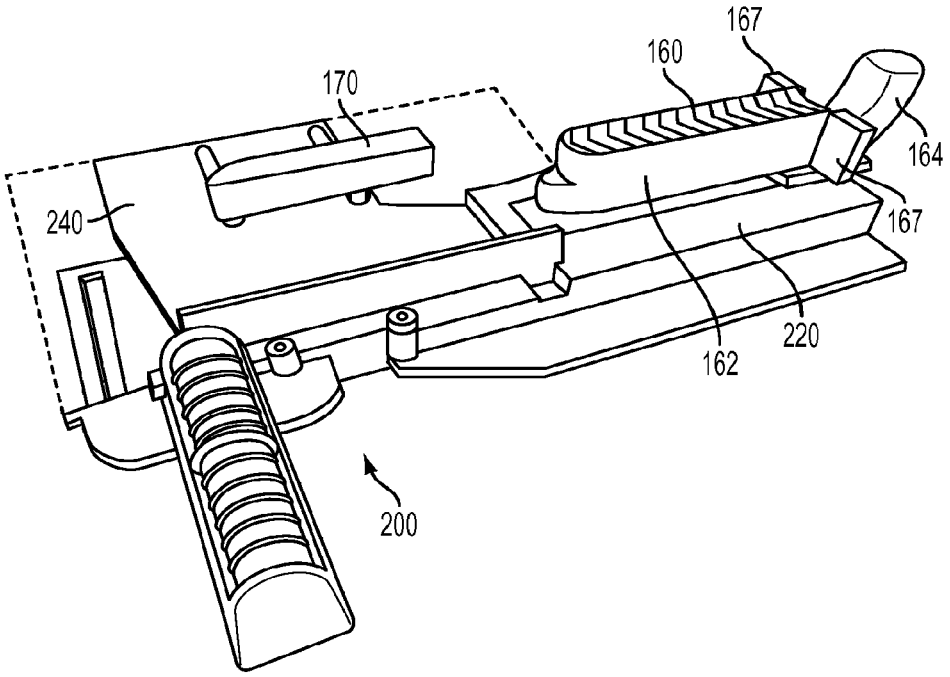
FIG. 10 is a side perspective view of the toy vehicle loader and launcher of FIG. 4.

Next, and with reference to FIGS. 8 and 9, launcher 160 includes launch rod 162 (shown in a top view in FIG. 8 and in a bottom view in FIG. 9), handle 164, and launcher bracket 166. Launch rod 162 comprises an elongate rod that extends generally parallel to the entrance portion 112 of the track set 100 to which it connects. Launch rod 162 may have a tapered tip 163 with a toy vehicle engaging hub 165 positioned at the free end of launch rod 162. A handle 164 is provided at the opposite end of launch rod 162 from toy vehicle engaging hub 165, and is configured for grasping preferably by one or two fingers of the user to pull launch rod 162 rearward on base 200 from its launch position (FIGS. 1 and 4) to the loading position (FIGS. 3 and 10). Handle 164 may optionally also have finger engagement wings 167 extending outward to either side of handle 164 as an alternative engagement mechanism allowing a user to grab and manipulate launcher 160.

Figure 3A:
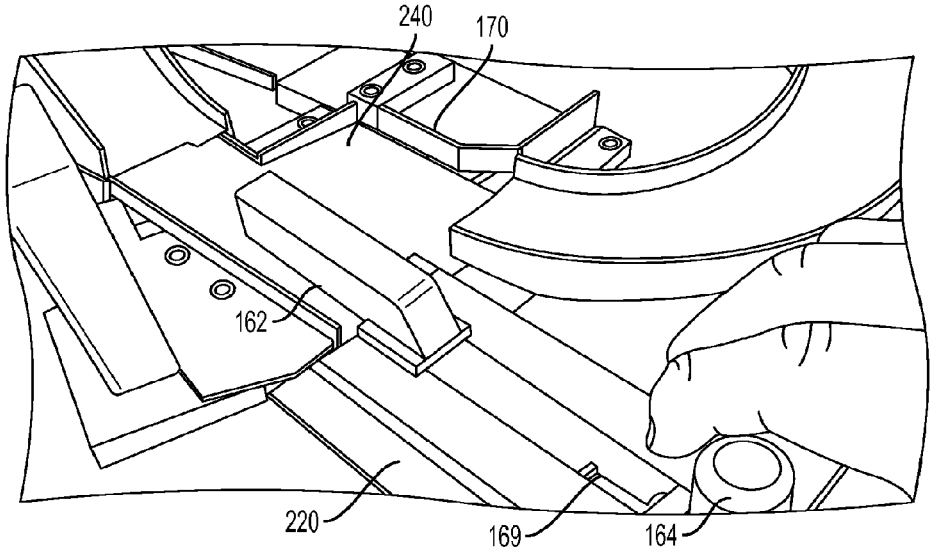
FIG. 3*a* is a close-up perspective view of the toy vehicle loader and launcher of FIG. 1 in a third configuration.

In the embodiment shown in FIGS. 4 through 10, handle 164 is affixed to launch rod 162. However, and with reference to FIGS. 1 through 3*a*, handle 164 may alternatively be releasably attached to launch rod 162, having a connecting hook 169 (shown in FIG. 3*a*) attached to and extending forward from the underside of handle 164, and engaging a catch surface (not shown) on the underside of launch rod 162. In this configuration, connecting hook 169 may initially engage the catch on the underside of launch rod 162, with the launch rod in the launch position (FIG. 1). A user may then pull back on handle 164, in turn pulling launch rod 162 back from the launch position to the load position (FIG. 3), and upon reaching an intended point toward the rear of launcher slot 222, be pushed out of contact with the catch on the bottom of launch rod 162 (such as by a catch release on the underside of base 200, not shown), releasing launch rod 162 from handle 164 and allowing launch rod 162 to spring forward, launching a toy vehicle 180 into entrance portion 112 of track set 100.

Referring again to FIGS. 6 through 9, launcher bracket 166 is positioned below base 200 and is affixed to launch rod 162 with a threaded member, such as a screw, bolt, or similarly configured connecting member extending from bracket 166, through launcher slot 222 and into the bottom of launch rod 162. The top surface of launcher bracket 166, and the bottom surface of launch rod 162 (or other portion of launcher 160 at which launcher bracket 166 attaches), are each wider than the width of launcher slot 222, such that the bracket and handle/launch rod assemblies may slide along launcher slot 222 without separating therefrom. Launcher bracket 166 includes preferably two rearward facing spring mounting hubs 161, each of which is positioned on opposite sides of a centerline of launcher slot 222. In order to launch toy vehicles 180 forward and onto track set 100, a launcher spring 163 (FIG. 7) is attached to each of spring mounting hubs 161 and launcher spring anchor 244, biasing the launch rod from the rearward, toy vehicle loading position (FIGS. 3 and 10) to the forward, toy vehicle launch position (FIGS. 1 and 4), such that when the pulling force exerted by the user on handle 164 is released, launch rod 162 will spring forward to launch a toy vehicle 180 onto track set 100.

Figure 11:
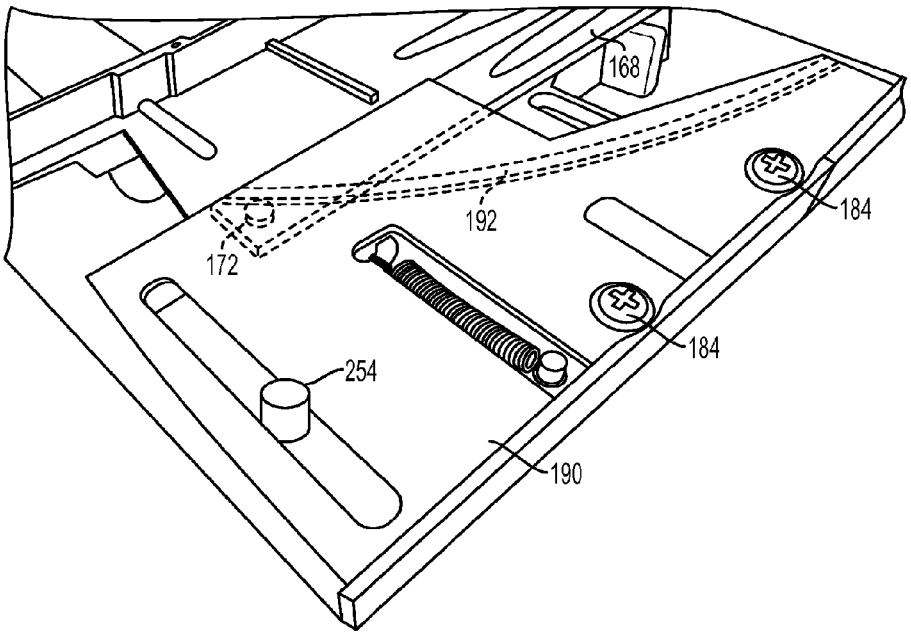
FIG. 11 is a bottom, close-up view of an actuator plate for use with the toy vehicle loader and launcher of FIG. 4.

With further reference to FIGS. 6 through 9 and the close-up view of actuator plate 190 of FIG. 11, launcher bracket 166 also includes extension rod 168 extending forward from launcher bracket 166 and toward the front end of base 200 and in a direction that is parallel to launcher slot 222, and thus to the direction of travel of launch rod 162 and handle 164. The forward end of extension rod 168 has a downwardly extending actuator plate engagement pin 172 that engages a guide ridge 192 that extends upward from a top side of actuator plate 190.

Figure 12:
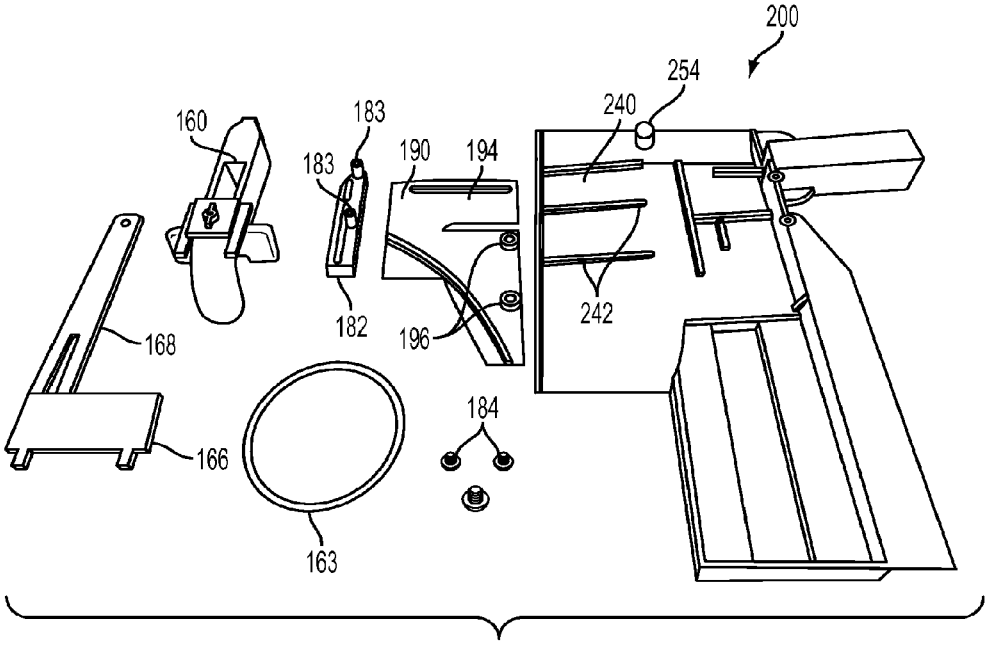
FIG. 12 is an exploded view of the toy vehicle loader and launcher of FIG. 4.

As shown in the exploded view of FIG. 12, loader 170 comprises actuator plate 190 and pusher 182. Actuator plate 190 is provided upwardly extending attachment hubs 196, each of which is configured to receive a downwardly extending connector pin 183 on pusher 182. Threaded connectors 184, such as screws, bolts or the like, extend upward through attachment hubs 196 on actuator plate 190, through loader slots 242 on loader section 240 of base 200, and into connector pins 183 on pusher 182. In this configuration, attachment hubs 196 are positioned within loader slots 242 and are configured to slide within loader slots 242, thus limiting the possible travel of actuator plate 190, and thus of pusher 182, to a horizontal movement that is generally perpendicular to the direction of movement of launch rod 162. Moreover (and as mentioned briefly above), actuator plate guide post 254 may also be provided on the underside of base 200 and may slide within guide slot 194 of actuator plate 190 to further assist in maintain the intended alignment of pusher 182 as it moves from the vehicle receiving position to the vehicle launch position.

Figure 13A:
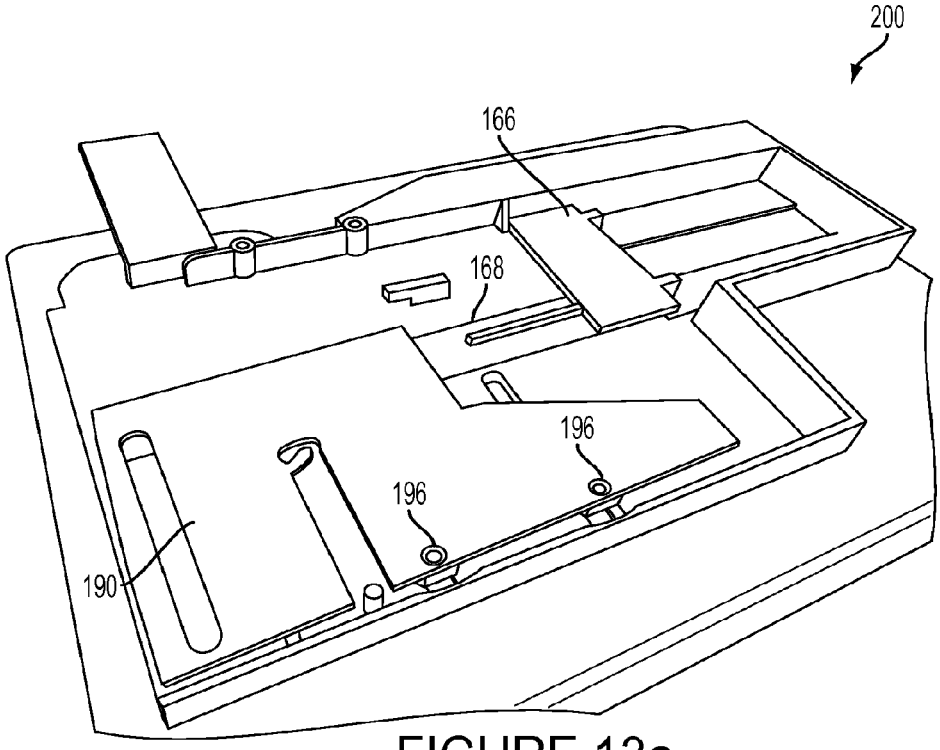
FIGS. 13*a*, 13*b*, and 13*c* are bottom perspective views of the toy vehicle loader and launcher of FIG. 4 in varied positions.
Figure 13B:
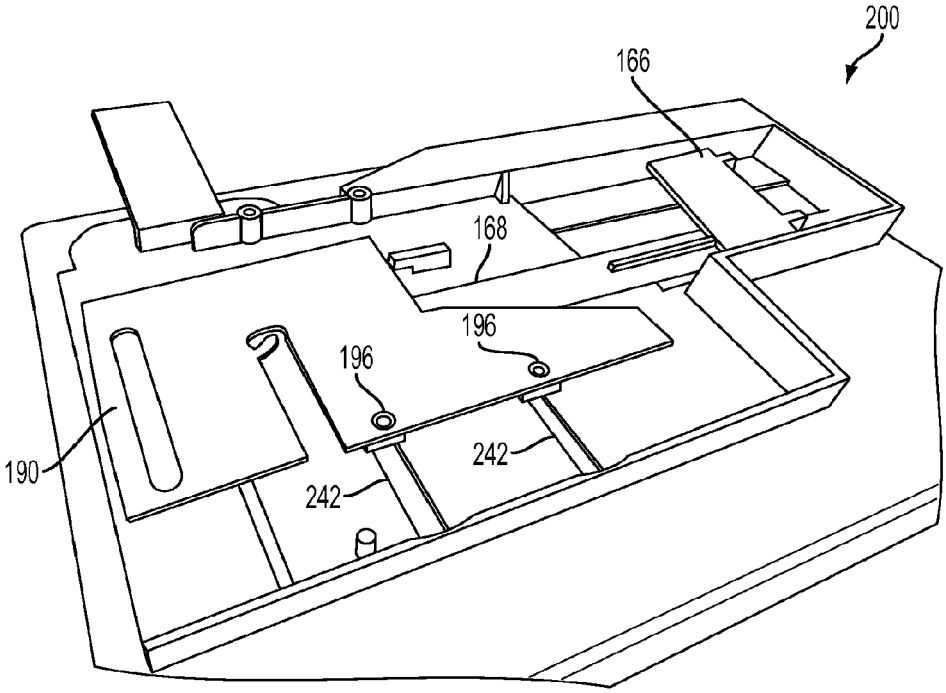
Figure 13C:
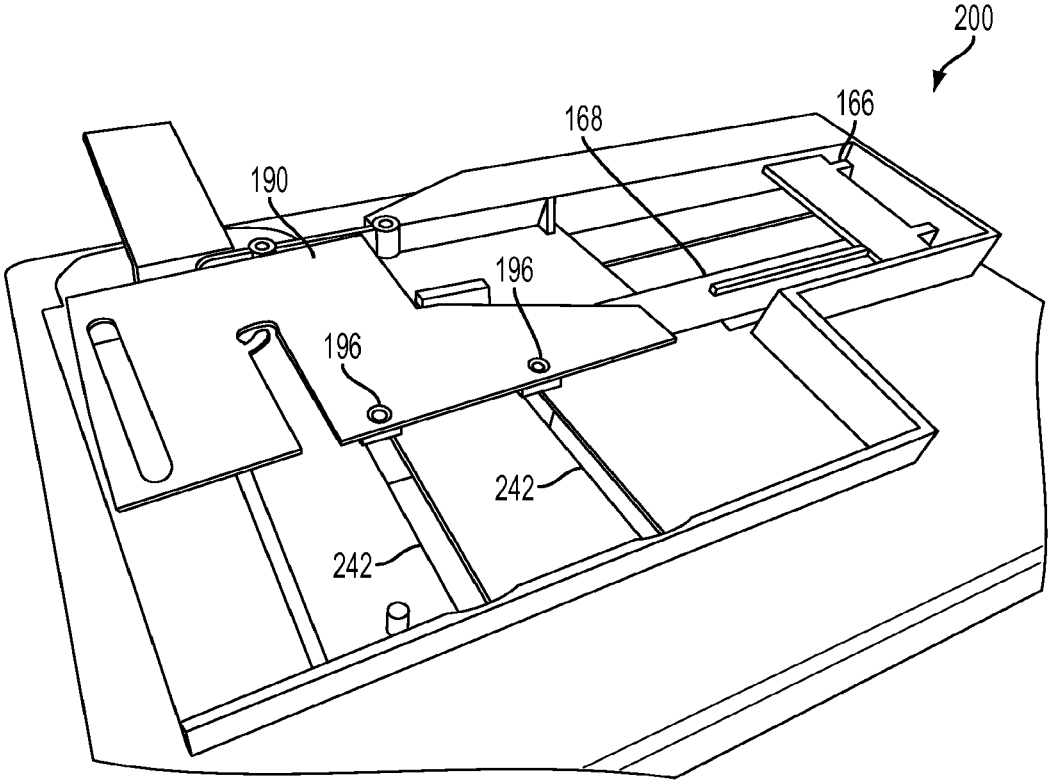

As best shown in FIG. 11, through the mechanical interaction of extension rod 168 with actuator plate 190, rearward movement of launch rod 162 causes actuator plate, and thus pusher 182, to move in a sideways direction (generally perpendicular to the direction of travel of launch rod 162) from the toy vehicle receiving position (FIGS. 11 and 13*a*) to the toy vehicle loading position (FIG. 13*c*). More particularly, as launch rod 162 is moved rearward, actuator plate engagement pin 172 on extension rod 168 likewise moves rearward, pushing against guide ridge 192 on the top face of actuator plate 190. As actuator plate engagement pin 172 pushes against guide ridge 192, it causes actuator plate 190 to move sideways, its movement being restricted to such a single, sideways direction by at least attachment hubs 196 interacting with loader slots 242. FIGS. 13*a* through 13*c* show the movement of extension rod 168 and actuator plate 190 from the launch position (FIG. 13*a*) to the load position (FIG. 13*c*). Specifically, FIG. 13*a* reflects the configuration in which launch rod 162 is at its forward most position (immediately after having launched a toy vehicle onto track set 100), and actuator plate 190 is positioned so that attachment hubs 196, and thus pusher 182, are closest to the outer edge of base 200 (in the toy vehicle receiving position of FIGS. 1 and 4). Likewise, FIG. 13*b* reflects the configuration in which launch rod 162 is pulled partially rearward through launcher slot 222, the movement of which (through interaction of actuator plate engagement pin 172 with guide ridge 192) causes actuator plate 190, and thus pusher 182, to move toward the path of launch rod 162, in turn pushing a toy vehicle toward the launch position. Finally, FIG. 13*c* reflects the configuration in which launch rod 162 is pulled fully rearward through launcher slot 222, which in turn positions actuator plate 190, and thus pusher 182, fully in the launch position with a toy vehicle now positioned immediately in front of launch rod 162 and ready for launch onto track set 100.

From this position, when a user releases handle 164, launcher spring 163 quickly pushes launch rod 162 forward, in turn launching a toy vehicle positioned in front of launch rod 162 onto track set 100. Likewise, as launch rod 162 is pulled forward, loader spring 191 pulls actuator plate 190, and thus pusher 182, back to the launch position of FIG. 13*a* and allows the toy vehicle to return to loader base section 240 in preparation for another launch.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

The invention claimed is:

1. A toy vehicle set comprising:

a launcher comprising a launcher rod coupled to a launcher bracket, the launcher being movable in a first direction between a toy vehicle load position and a toy vehicle launch position;

a loader comprising an actuator plate coupled to a pusher, the actuator plate and pusher being movable in a second direction between a first position and a second position, the second direction being generally perpendicular to the first direction;

wherein the launcher bracket engages the actuator plate to movably couple the launcher and the loader along a guide;

wherein movement of the launcher from the toy vehicle load position and the toy vehicle launch position in the first direction causes movement of the loader from the first position and the second position in the second direction.

2. The toy vehicle set of claim 1, wherein the launcher and the loader are coupled to a base.

3. The toy vehicle set of claim 2, wherein the base comprises a launcher base section and a loader base section.

4. The toy vehicle set of claim 3, wherein the launcher base section comprises a launcher slot configured to guide the launcher along the first direction and wherein the loader base section comprises one or more loader slots aligned at an angle to the launcher slot to guide the loader along the second direction.

5. The toy vehicle set of claim 4, wherein the launcher bracket is configured to ride along the launcher slot while carrying the launcher rod between the toy vehicle load position and the toy vehicle launch position.

6. The toy vehicle set of claim 4, wherein a front end of the launcher slot comprises a cushion member to protect the front end of the launcher slot from damage from repeated impacts with the launcher rod.

7. The toy vehicle set of claim 3, further comprising a loader spring coupling the actuator plate to a loader spring anchor disposed on the loader base section.

8. The toy vehicle set of claim 3, wherein the loader base section comprises a guide post positioned to slide within a guide slot on the actuator plate to assist in guiding the actuator plate as it moves between the first and second positions.

9. The toy vehicle set of claim 3, further comprising track loop portion comprising an entrance portion and an exit portion, wherein the entrance portion is coupled to the launcher base section and the exit portion is coupled to the loader base section, and wherein the entrance portion and the exit portion extend in generally parallel directions.

10. The toy vehicle set of claim 9, wherein the entrance portion and the exit portion of the track loop portion are laterally offset from one another.

11. The toy vehicle of claim 10, wherein the pusher moves laterally across the base section in the second direction as the launcher is moved from the toy vehicle launch position to the toy vehicle load position in the first direction to push the toy vehicle from the loader base section to the launcher base section.

12. The toy vehicle set of claim 2, further comprising a launcher spring coupling the launcher to the base, the launcher spring resiliently biasing the launcher to the toy vehicle launch position.

13. The toy vehicle set of claim 12, wherein the launcher base section comprises a launcher spring anchor and the launcher bracket comprises at least one spring mounting hub and wherein the launcher spring couples the launching spring anchor and the at least one spring mounting hub.

14. The toy vehicle set of claim 13, wherein the launcher bracket comprises two spring mounting hubs positioned on opposite sides of a centerline of a launcher slot and wherein a first portion of the launcher spring is coupled to the launcher spring anchor and wherein second portions of the launcher spring are each coupled to one of the two spring mounting hubs of the of the launcher bracket.

15. The toy vehicle set of claim 2, further comprising a loader spring coupling the loader to the base, the loader spring resiliently biasing the loader to the second position.

16. The toy vehicle set of claim 2, wherein the actuator plate is disposed on an underside of the base and the pusher is disposed on a top side of the base and wherein the actuator plate and the pusher are coupled to one another through loader slots disposed on the base and, the loader slots extending in the second direction.

17. The toy vehicle set of claim 1, further comprising a handle coupled to the launch rod.

18. The toy vehicle set of claim 17, wherein the handle is releasably attached to the launch rod, wherein when the handle is attached to the launch rod, movement of the handle from a vehicle load position to a vehicle launch position will cause the handle to be pushed out of contact with the launch rod to allow the launch rod to return to the vehicle launch position.

19. The toy vehicle set of claim 1, wherein the launcher bracket is disposed on an underside of the base and the launch rod is disposed on a top side of the base and wherein the launcher bracket and the launch rod are coupled to one another through a launcher slot.

20. The toy vehicle set of claim 1, wherein the guide is provided on the actuator plate and wherein the launcher bracket further comprises an actuator plate pin that engages the guide.

* * * * *